US005592689A

United States Patent [19]

Matthews

[11] Patent Number: 5,592,689

[45] Date of Patent: Jan. 14, 1997

[54] SOUND-EMITTING KNEE APPARATUS

[76] Inventor: Jacqueline R. Matthews, 5355 Santa Rosa Ave., Sparks, Nev. 89436

[21] Appl. No.: 516,957

[22] Filed: Aug. 18, 1995

[51] Int. Cl.[6] ..... A41D 13/06

[52] U.S. Cl. ..... 2/23; 2/24; 446/26

[58] Field of Search ..... 2/62, 22, 23, 24; 36/132, 139; 446/26, 28

[56] References Cited

U.S. PATENT DOCUMENTS

| | | | |
|---|---|---|---|
| D. 338,281 | 8/1993 | Bottorff et al. . | |
| 847,240 | 3/1907 | Chamberlain | 446/26 |
| 3,501,144 | 3/1970 | Schmidt | 36/139 X |
| 3,965,486 | 6/1976 | Lightbody | 2/24 |
| 4,040,619 | 8/1977 | Landi . | |
| 4,380,134 | 4/1983 | Taluba et al. . | |
| 4,490,855 | 1/1985 | Figgie, III et al. . | |
| 4,561,123 | 12/1985 | Hull | 2/23 |
| 4,879,765 | 11/1989 | Bailie et al. . | |
| 5,031,240 | 7/1991 | Nierhaus . | |
| 5,285,585 | 2/1994 | Baker | 36/139 X |
| 5,433,437 | 7/1995 | Dudley | 36/139 X |

FOREIGN PATENT DOCUMENTS

| | | | |
|---|---|---|---|
| 2195522 | 4/1988 | United Kingdom | 36/132 |

*Primary Examiner*—Paul C. Lewis

[57] ABSTRACT

A sound-emitting knee pad apparatus includes a pad assembly which emits a sound when located between a knee of an infant person and a floor surface when the person is crawling on the floor surface. A pad connector assembly connects the pad assembly to a knee of the person or to an outside surface of a knee-juxtaposed region of a garment worn by the person. The pad connector assembly includes a first connector assembly attached to an outside surface of a knee-juxtaposed region of a garment. A second connector assembly is attached to an outside surface of the pad assembly. The first connector assembly is a quantity of hook-or-loop connector material. The second connector assembly is a quantity of complementary loop-or-hook connector material. The pad assembly may be comprised of a rubber material. Alternatively, the pad assembly may include an air chamber assembly which includes a plurality of resilient exterior walls which define an interior air chamber. A whistle assembly is supported by one of the resilient exterior walls. The whistle assembly provides an air communication path between the interior air chamber and air outside the interior air chamber. The pad connector assembly may include a strap assembly which includes a first end connected to a first side of the pad assembly and includes a second end connected to a second side of the pad assembly. The strap assembly is comprised of elastic resilient material.

3 Claims, 4 Drawing Sheets

FIG 1
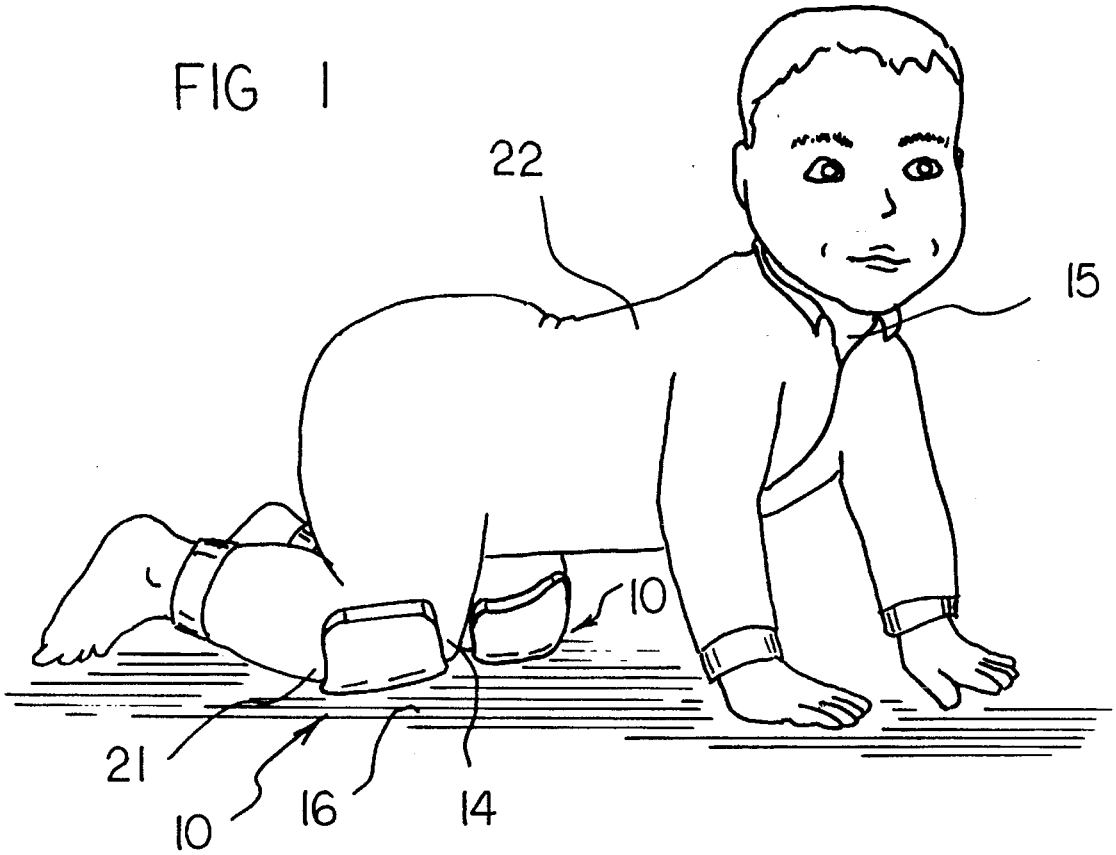
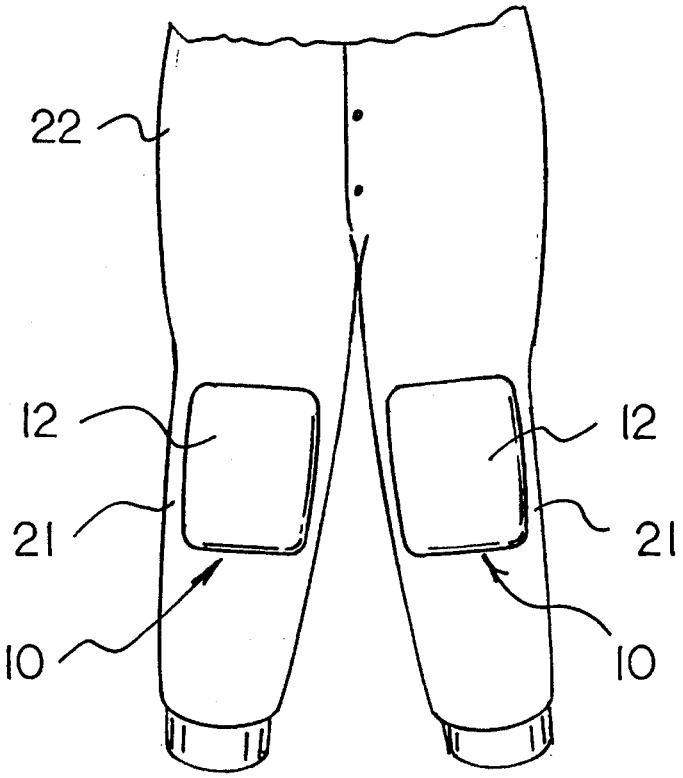
FIG 2

SOUND-EMITTING KNEE APPARATUS

BACKGROUND OF THE INVENTION

1. Field of the Invention

The present invention relates generally to knee pads and, more particularly, to knee pads especially provided for use by infants.

2. Description of the Prior Art

Infants, before they are able to walk, do a lot of crawling on floors within dwellings. Often, because of their low profile near the floor, infants who are crawling are difficult for adults to see. As a result, there is an increased risks of accidental collisions between the adults and the infants to occur. In this respect, it would be desirable if a device were provided which signaled an adult the presence of a crawling infant.

When an infant crawls, the infant places one's body weight primarily on one's hands and knees. Since the hands are used for much more than bearing weight, it would be desirable if a device were provided that signals an adult the presence of a crawling infant which depends upon movement of the infant's knees as the infant crawls.

When an infant crawls along a floor, often times the infant is wearing some kind of garment that covers the legs and knees. In this respect, it would be desirable if a garment were provided which enables movement of an infant's knees across a floor to signal an adult the presence of the infant. At other times when an infant crawls along a floor, the infant does not wear a garment that covers the knees. In such a case, it would be desirable if a device were provided which enables movement of an infant's knees along a floor to alert the adult to the presence of the infant even when the infant is not wearing a garment that covers the knees.

It is a well known phenomenon that some foot wear causes a squeaking sound to emanate when the foot wear rubs up against a floor. In this respect, it would be desirable to provide devices to be worn on an infant's knees that cause a squeaking sound to emanate when the knee-worn device rubs up against a floor.

There are floors, such as carpeted floors, that preclude the occurrence of a squeaking sound to be caused when a knee-worn device rubs up against a floor. In this respect, it would be desirable if a device were provided which permits a knee-worn device to cause a sound to be emanated when the knee moves across a carpeted floor.

As a matter of interest, throughout the years, a number of innovations have been developed relating to knee pads, and the following U.S. Pat. Nos. are representative of some of those innovations: 4,490,855; 4,879,765; 5,031,240; and Des. 338,281. It is noted that none of these patents disclose a means for generating a squeaking sound when the knee pads move along a floor.

Also as a matter of interest, the following U.S. Pat. Nos. are cited for their disclosure of squeeze toys: 4,040,619 and 4,380,134. It is noted that U.S. Pat. No. 4,380,134 discloses a squeeze toy which provides a whistling sound when the toy is squeezed. It is noted that neither patent discloses the use of the respective patented devices on an infant's knee. In this respect, it would be desirable if a device were provided which causes a whistling sound to emanate when the device is worn on a crawling infant's knee.

Still other features would be desirable in a sound-emitting knee pad apparatus. For example, it would be desirable for a sound-emitting knee pad device to be easily selectively attached to or removed from a garment.

Thus, while the foregoing body of prior art indicates it to be well known to use knee pads for infants, the prior art described above does not teach or suggest a knee pad apparatus which has the following combination of desirable features: (1) provides an audio signal to an adult indicating the presence of a crawling infant; (2) provides an audio signal for a crawling infant which depends upon movement of the infant's knees as the infant crawls; (3) provides a garment which enables movement of an infant's knees across a floor to signal an adult the presence of the infant; (4) enables movement of an infant's knees along a floor to alert the adult to the presence of the infant even when the infant is not wearing a garment that covers the knees; (5) provide devices to be worn on an infant's knees that cause a squeaking sound to emanate when the knee-worn device rubs up against a floor; (6) permits a knee-worn device to cause a sound to be emanated when the knee moves across a carpeted floor; (7) causes a whistling sound to emanate when the device is worn on a crawling infant's knee; and (8) easily selectively is attached to or removed from a garment. The foregoing desired characteristics are provided by the unique sound-emitting knee pad apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a sound-emitting knee pad apparatus which includes a pad assembly which emits a sound when located between a knee of an infant person and a floor surface when the person is crawling on the floor surface. A pad connector assembly connects the pad assembly to a knee of the person or to an outside surface of a knee-juxtaposed region of a garment worn by the person. The pad connector assembly includes a first connector assembly attached to an outside surface of a knee-juxtaposed region of a garment. A second connector assembly is attached to an outside surface of the pad assembly.

The first connector assembly is a quantity of hook-or-loop connector material. The second connector assembly is a quantity of complementary loop-or-hook connector material. The pad assembly may be comprised of a rubber material.

Alternatively, the pad assembly may include an air chamber assembly which includes a plurality of resilient exterior walls which define an interior air chamber. A whistle assembly is supported by one of the resilient exterior walls. The whistle assembly provides an air communication path between the interior air chamber and air outside the interior air chamber.

The pad connector assembly may include a strap assembly which includes a first end connected to a first side of the pad assembly and includes a second end connected to a second side of the pad assembly. The strap assembly is comprised of elastic resilient material.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sound-emitting knee pad apparatus which has all of the advantages of the prior art and none of the disadvantages.

It is another object of the present invention to provide a new and improved sound-emitting knee pad apparatus which may be easily and efficiently manufactured and marketed.

It is a further object of the present invention to provide a new and improved sound-emitting knee pad apparatus which is of durable and reliable construction.

An even further object of the present invention is to provide a new and improved sound-emitting knee pad apparatus which is susceptible of a low cost of manufacture with regard to both materials and labor, and which accordingly is then susceptible of low prices of sale to the consuming public, thereby making such sound-emitting knee pad apparatus available to the buying public.

Still yet a further object of the present invention is to provide a new and improved sound-emitting knee pad apparatus which provides an audio signal to an adult indicating the presence of a crawling infant.

Still another object of the present invention is to provide a new and improved sound-emitting knee pad apparatus that provides an audio signal for a crawling infant which depends upon movement of the infant's knees as the infant crawls.

Yet another object of the present invention is to provide a new and improved sound-emitting knee pad apparatus which provides a garment which enables movement of an infant's knees across a floor to signal an adult the presence of the infant.

Even another object of the present invention is to provide a new and improved sound-emitting knee pad apparatus that enables movement of an infant's knees along a floor to alert the adult to the presence of the infant even when the infant is not wearing a garment that covers the knees.

Still a further object of the present invention is to provide a new and improved sound-emitting knee pad apparatus which provide devices to be worn on an infant's knees that cause a squeaking sound to emanate when the knee-worn device rubs up against a floor.

Yet another object of the present invention is to provide a new and improved sound-emitting knee pad apparatus that permits a knee-worn device to cause a sound to be emanated when the knee moves across a carpeted floor.

Still another object of the present invention is to provide a new and improved sound-emitting knee pad apparatus which causes a whistling sound to emanate when the device is worn on a crawling infant's knee.

Yet another object of the present invention is to provide a new and improved sound-emitting knee pad apparatus that easily selectively attached to or removed from a garment.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a first embodiment of the sound-emitting knee pad apparatus of the invention attached to the knee area of a garment worn by an infant.

FIG. 2 is a front view of the embodiment of the sound-emitting knee pad apparatus shown in FIG. 1.

DESCRIPTION OF THE PREFERRED EMBODIMENT

Figure 3:
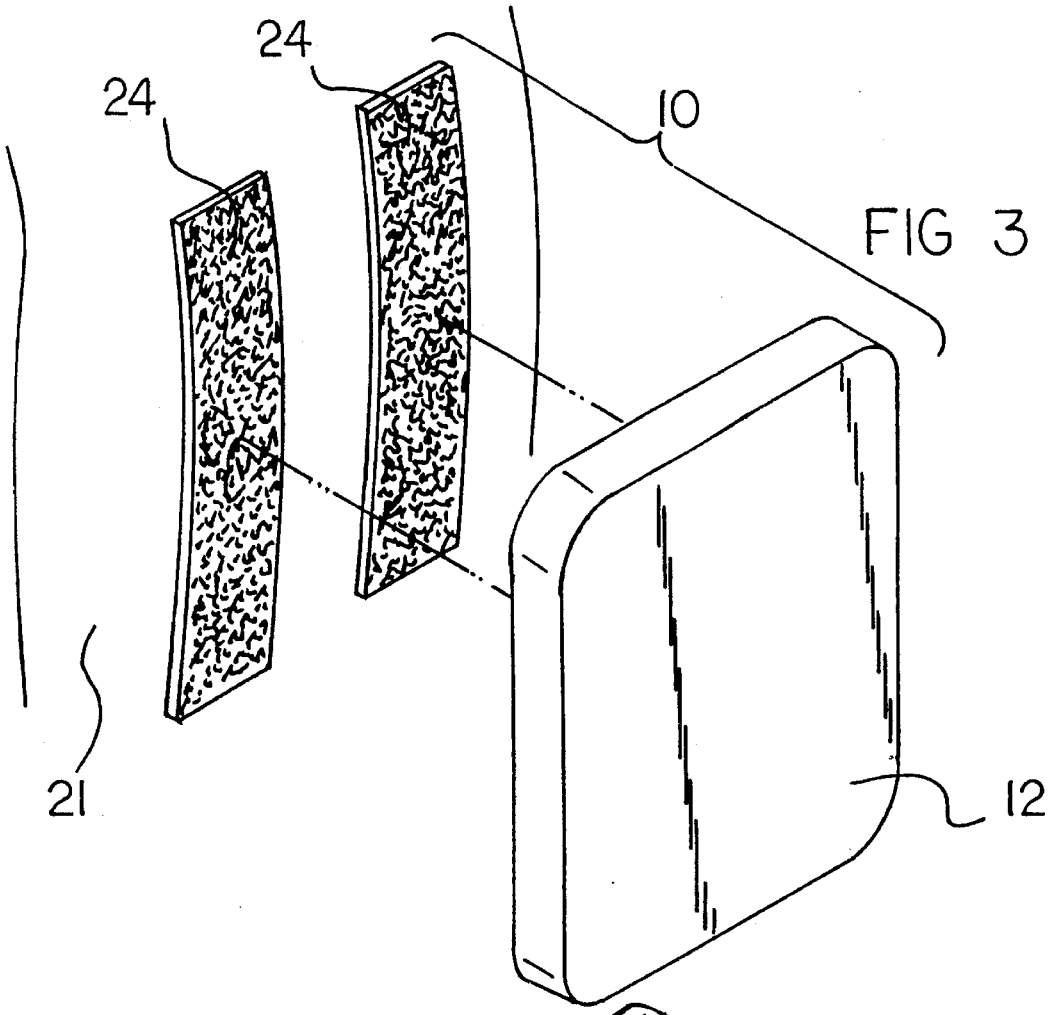
FIG. 3 is an enlarged perspective view of the embodiment of the sound-emitting knee pad apparatus of FIG. 2 having been separated from the garment.
Figure 4:
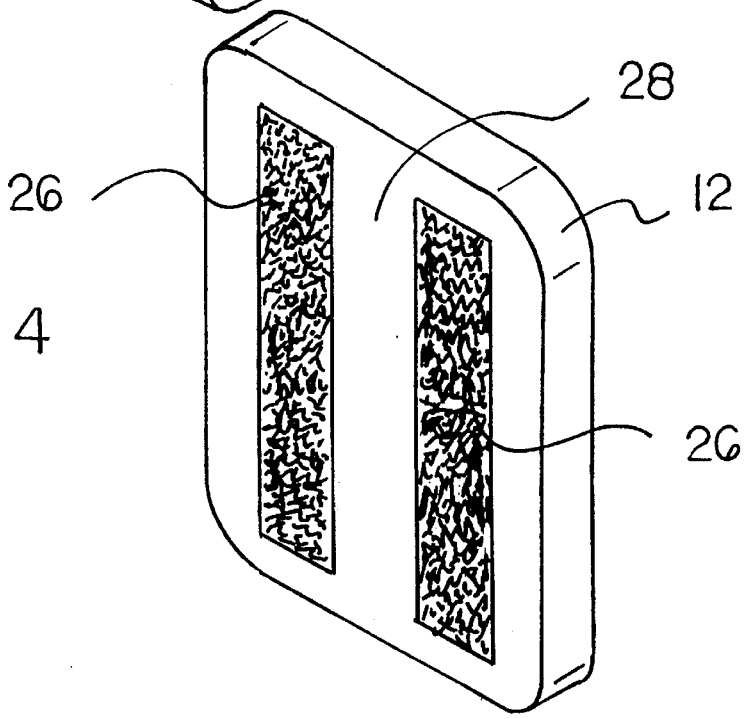
FIG. 4 is a reverse perspective view of the embodiment of the invention shown in FIG. 3.

With reference to the drawings, a new and improved sound-emitting knee pad apparatus embodying the principles and concepts of the present invention will be described.

Turning to FIGS. 1–4, there is shown a first embodiment of the sound-emitting knee pad apparatus of the invention generally designated by reference numeral 10. The sound-emitting knee pad apparatus 10 includes a pad assembly 12 which emits sound when located between a knee 14 of an infant person 15 and a floor surface 16 when the person 15 is crawling on the floor surface 16. A pad connector assembly 18 connects the pad assembly 12 to a knee 14 of the person 15 or to an outside surface of a knee-juxtaposed region 21 of a garment 22 worn by the person 15. The pad connector assembly 18 includes a first connector assembly 24 attached to an outside surface of a knee-juxtaposed region 21 of a garment 22. A second connector assembly 26 is attached to an outside surface 28 of the pad assembly 12.

The first connector assembly 24 is a quantity of hook-or-loop connector material 24. The second connector assembly 26 is a quantity of complementary loop-or-hook connector material 26. The hook-or-loop connector material 24 and the loop-or-hook connector material 26 can be made from well known VELCRO™ material.

The pad assembly 12 is comprised of a rubber material. The rubber material is of a type which squeaks when rubbed across polished wooden, stone, and linoleum floor surfaces.

In using the first embodiment of the invention, a knee-juxtaposed region 21 of a garment 22 is equipped with hook-or-loop connector material 24. A pad assembly 12 has complementary loop-or-hook connector material 26 attached thereto. The pad assembly 12 is connected to the garment 22 by connecting the loop-or-hook connector material 26 to the complementary hook-or-loop connector material 24. When the infant person 15 crawls on a polished floor surface 16, the pad assembly 12 rubs up against the polished floor surface 16 and creates a squeaking sound.

The combination of the pad assembly 12 and the loop-or-hook connector material 26 can be removed from the garment 22, which has the hook-or-loop connector material 24 attached thereto, when it is desired to launder the garment 22 or when it is desired to remove the person 15 from the floor surface 16 and to place the person 15 in bed.

Figure 5:
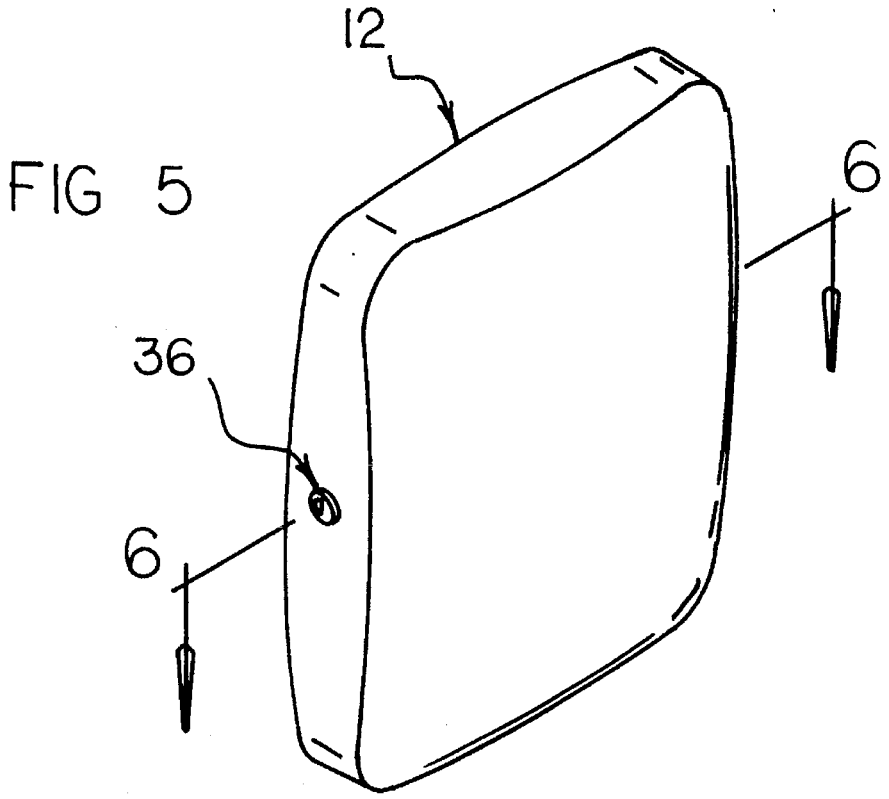
FIG. 5 is a perspective view of a second embodiment of the invention.
Figure 6:
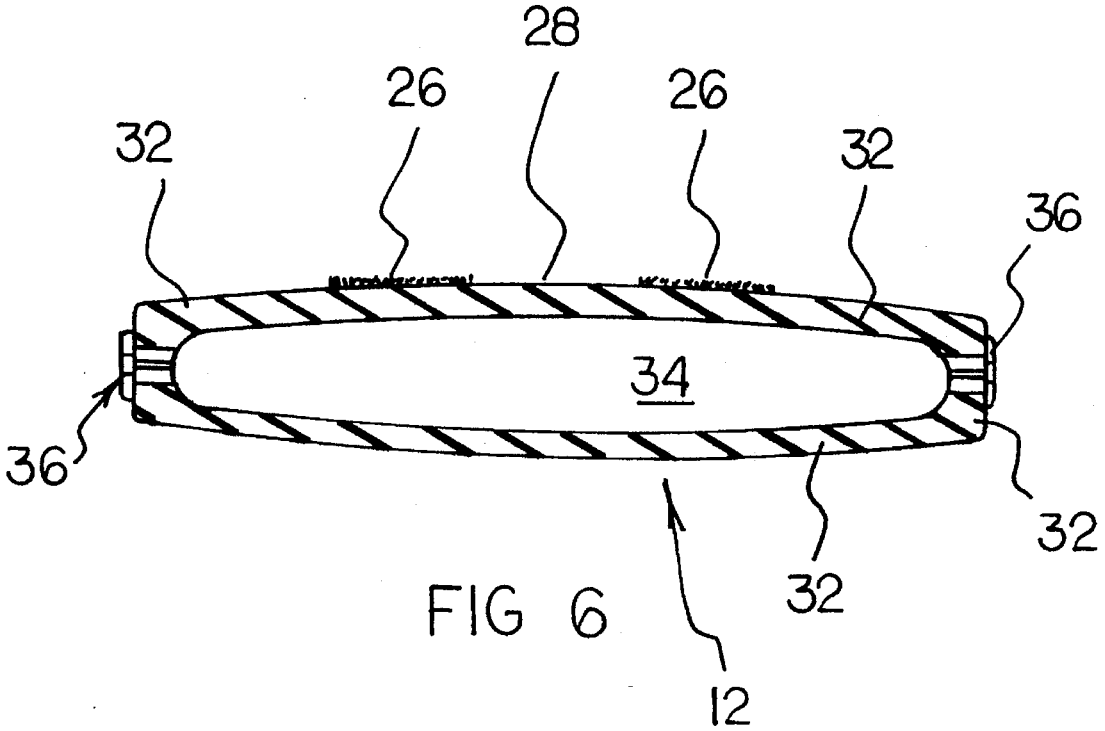
FIG. 6 is an enlarged cross-sectional view of the embodiment of the invention shown in FIG. 5.

Turning to FIGS. 5–6, a second embodiment of the invention is shown. Reference numerals are shown that correspond to like reference numerals that designate like elements shown in the other figures. In addition, the pad assembly 12 includes an air chamber assembly 30 which includes a plurality of resilient exterior walls 32 which define an interior air chamber 34. A whistle assembly 36 is supported by one of the resilient exterior walls 32. The whistle assembly 36 provides an air communication path between the interior air chamber 34 and air outside the interior air chamber 34.

In using the second embodiment of the invention, a quantity of loop-or-hook connector material 26 is attached to the inwardly-facing side 28 of the pad assembly 12, and the loop-or-hook connector material 26 is connected to the complementary hook-or-loop connector material 24 located on the knee-juxtaposed region 21 of the garment 22. When a portion the weight of the person 15 is placed on the pad assembly 12, a portion of the air contained within the interior air chamber 34 is expelled out of the interior air chamber 34 through the whistle assembly 36. As the air exits from the whistle assembly 36, a whistling sound is created. When the weight of the person 15 is lifted from the pad assembly 12, the resilient nature of the exterior walls 32 causes the exterior walls 32 to return to their original status in which the weight of the person 15 is not born. As a result, some air that is exterior to the interior air chamber 34 passes through the whistle assembly 36 in a reverse direction to return to the interior air chamber 34. In this way, the interior air chamber 34 is refilled. When weight of the person 15 is placed on the pad assembly 12 again, the air-expelling and whistling steps occur again. The whistling sound provided by the whistle assembly 36 when air is expelled from the interior air chamber 34 of the pad assembly 12 provides an audible signal to an adult that the infant person 15 is crawling of a floor surface 16.

With the second embodiment of the invention, the floor surface 16 can be either polished or carpeted. The audible signaling of the apparatus does not depend upon the nature of the floor surface 16. Instead, the audible nature of the pad assembly 12 depends on the fact that the pad assembly 12 bears a portion of the weight of the person 15 when the person is crawling on the floor surface 16.

Figure 7:
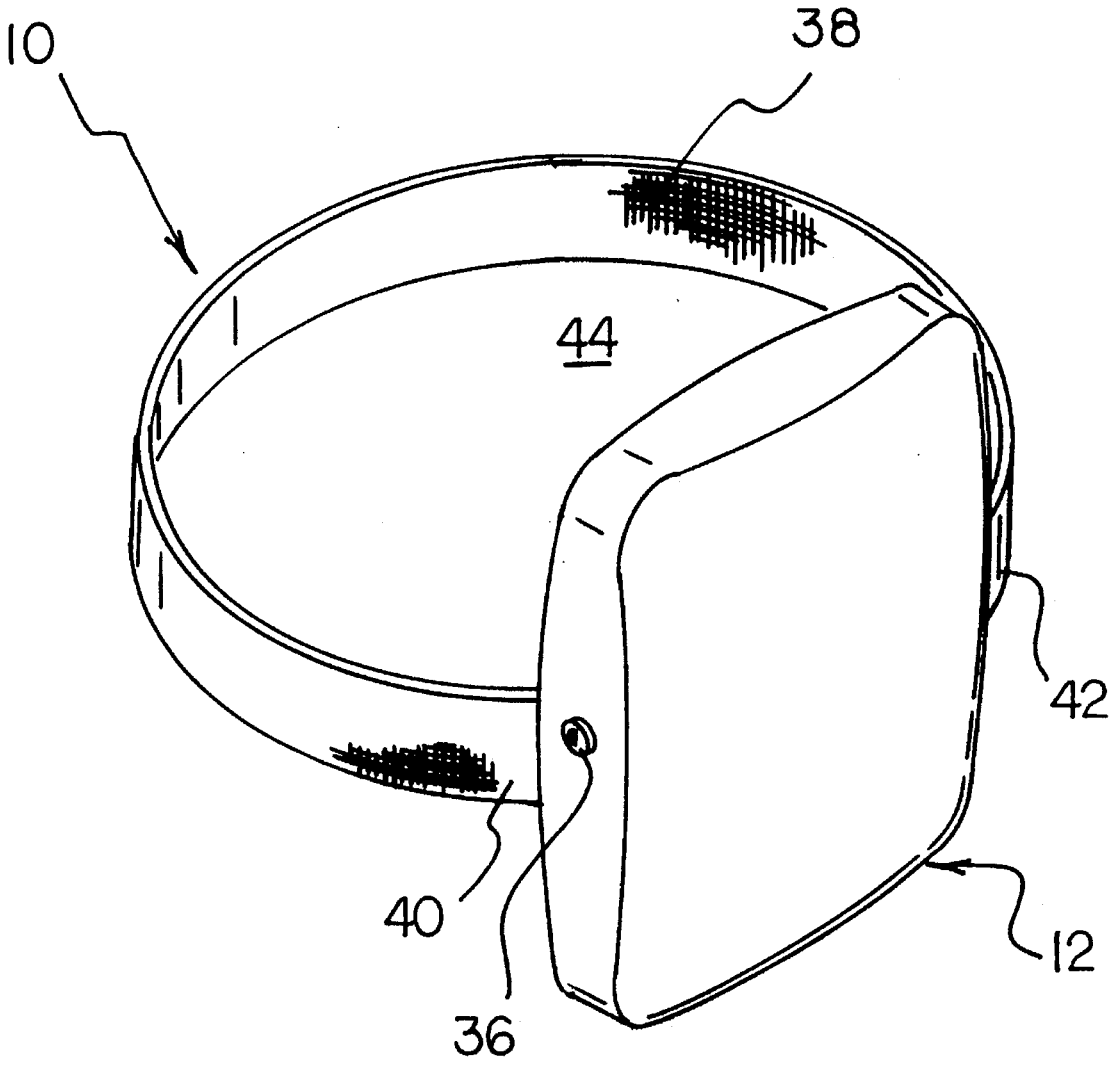
FIG. 7 is a perspective view of a third embodiment of the invention which includes an elastic strap for encompassing an infant's knee to keep the sound-emitting knee pad apparatus from slipping off of the knee area.

Turning to FIG. 7, a third embodiment of the invention is shown. Reference numerals are shown that correspond to like reference numerals that designate like elements shown in the other figures. In addition, the pad connector assembly 18 includes a strap assembly 38 which includes a first end 40 connected to a first side of the pad assembly 12 and includes a second end 42 connected to a second side of the pad assembly 12. The strap assembly 38 is comprised of elastic resilient material.

In using the third embodiment of the invention, a foot and leg of a person 15 are passed through the interior region 44 defined by the strap assembly 38 and the pad assembly 12. The pad assembly 12 is placed over the knee 14 of the person 15. The strap assembly 38 keeps the pad assembly 12 properly positioned on the knee 14 of the person 15. With this embodiment of the invention, it does not matter whether the person 15 is wearing a garment 22 or not. With the third embodiment of the invention, if the pad assembly 12 includes an interior air chamber 34 and a whistle assembly 36, the third embodiment of the invention provides an audible signal in the manner of the second embodiment of the invention. On the other hand, if the pad assembly 12 is like the pad assembly 12 in the first embodiment of the invention, then the pad assembly 12 provides a squeaking audible signal in the same manner as the first embodiment of the invention.

The components of the sound-emitting knee pad apparatus of the invention can be made from inexpensive and durable plastic and rubber materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved sound-emitting knee pad apparatus that is low in cost, relatively simple in design and operation, and which may advantageously be used to provide an audio signal to an adult indicating the presence of a crawling infant. With the invention, a sound-emitting knee pad apparatus provides an audio signal for a crawling infant which depends upon movement of the infant's knees as the infant crawls. With the invention, a sound-emitting knee pad apparatus provides a garment which enables movement of an infant's knees across a floor to signal an adult the presence of the infant. With the invention, a sound-emitting knee pad apparatus is provided which enables movement of an infant's knees along a floor to alert the adult to the presence of the infant even when the infant is not wearing a garment that covers the knees. With the invention, a sound-emitting knee pad apparatus is provided which provide devices to be worn on an infant's knees that cause a squeaking sound to emanate when the knee-worn device rubs up against a floor. With the invention, a sound-emitting knee pad apparatus is provided which permits a knee-worn device to cause a sound to be emanated when the knee moves across a carpeted floor. With the invention, a sound-emitting knee pad apparatus is provided which causes a whistling sound to emanate when the device is worn on a crawling infant's knee. With the invention, a sound-emitting knee pad apparatus is provided which easily selectively is attached to or removed from a garment.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A sound-emitting knee pad apparatus 10, comprising:

a garment 22 which includes a knee-juxtaposed region 21 and an outside surface, a first connector assembly 24 attached to said outside surface of said knee-juxtaposed region 21 of said garment 22, a pad assembly 12 which emits a sound when located between a knee 14 of a person 15 and a floor surface 16 when the person 15 is crawling on the floor surface 16, wherein said pad assembly 12 includes an air chamber assembly which includes a plurality of resilient exterior walls 32 which define an interior air chamber 34, and a whistle assembly 36 supported by one of said resilient exterior walls 32, wherein said whistle assembly 36 provides an air communication path between said interior air chamber 34 and air outside said interior air chamber 34, and a second connector assembly 26 attached to an outside surface 28 of said pad assembly 12 for connecting said pad assembly 12 to said first connector assembly 24.

2. The apparatus of claim 1 wherein:

said first connector assembly 24 is a quantity of hook-or-loop connector material 24, and said second connector assembly 26 is a quantity of complementary loop-or-hook connector material 26.

3. A method of providing an audio signal indicating the presence of a crawling person, comprising the steps of:

obtaining a pad assembly 12 which includes an air chamber assembly which includes a plurality of resilient exterior walls 32 which define an interior air chamber 34, wherein a whistle assembly 36 is supported by one of the resilient exterior walls 32, attaching the pad assembly to either a knee of the person or a knee-juxtaposed region 21 of a garment worn by the person, and permitting the person to crawl, whereby air in the interior air chamber 34 of pad assembly 12 is expelled through the whistle assembly 36 providing an audible signal indicating that the person is crawling.

* * * * *